US005665008A

United States Patent [19]

Chaney

[11] Patent Number: 5,665,008

[45] Date of Patent: Sep. 9, 1997

[54] GOLF TRAINING APPARATUS

[75] Inventor: Scott L. Chaney, Dublin, Ohio

[73] Assignee: Distance Doctor. Inc., Dublin, Ohio

[21] Appl. No.: 664,244

[22] Filed: Jun. 7, 1996

Related U.S. Application Data

[60] Provisional application No. 60/000,113, Jun. 9, 1995.

[51] Int. Cl.[6] ..... A63B 69/36

[52] U.S. Cl. ..... 473/271; 473/273; 473/277; 473/286; 294/19.2; 403/377; 248/156; 206/579

[58] Field of Search ..... 473/266, 267, 473/268, 269, 270, 271, 272, 273, 274, 275, 277, 286

[56] References Cited

U.S. PATENT DOCUMENTS

| | | | |
|---|---|---|---|
| 3,079,152 | 2/1963 | Cushing | 473/277 |
| 3,243,186 | 3/1966 | Johnson | 473/274 |
| 3,623,733 | 11/1971 | Cavanaugh | 473/277 X |
| 4,659,084 | 4/1987 | Vuick | 473/275 X |
| 4,817,953 | 4/1989 | Ponchak | 473/277 X |
| 5,435,727 | 7/1995 | Dobson | 473/272 X |

*Primary Examiner*—George J. Marlo
*Attorney, Agent, or Firm*—Standley & Gilcrest

[57] ABSTRACT

A golf training apparatus, comprising:

an elongated tube having a first and second end, and a length sufficient to regulate a golfer's stance;

a lower leg lateral restraint having a first and second end, said lower leg lateral restraint movably positioned within said first end of said elongated tube, said first end of said lower leg lateral restraint having a sharp point for facilitating the insertion of said lower leg lateral restraint into the ground;

a lateral foot restraint having a first and second end, said lateral foot restraint movably positioned within said second end of said elongated tube, said first end of said lateral foot restraint having a sharp point for facilitating the insertion of said lateral foot restraint into the ground;

a locking mechanism for locking said elongated tube, said lower leg lateral restraint, and said lateral foot restraint together; and wherein said elongated tube, said lower leg lateral restraint, and said lateral foot restraint can be disassembled into separate components for use as a golf training apparatus.

8 Claims, 2 Drawing Sheets

GOLF TRAINING APPARATUS

This application claims the benefit of U.S. Provisional Application No. 60/000,113 filed Jun. 9, 1995.

BACKGROUND AND SUMMARY OF THE INVENTION

The present invention relates generally to a golf training apparatus and method, and more particularly to a portable, multi-purpose, golf training apparatus for improving all aspects of a golfer's game.

Traditionally, golf training devices have been limited to improving one aspect of a golfer's game. For example, a device may assist in improving one's putting stroke while another device improves the swing of the golfer. Additionally, traditional golf training devices have solely concentrated on altering the motion of the golfer's swing. These devices are lacking because they do not assist a golfer in every aspect of a golf game. Improvements in all aspects of a golfer's game, including the swing, the putting, the stance, the weight/balance of the golfer, ball positioning, and body and ball alignment, is needed to truly improve one's golf game. Until the present invention, the only source of improving all aspects of one's golf game has been expensive, personalized, lessons given by the local golf pro.

The present invention improves all aspects of a golfer's game, including:

1) body and ball alignment;

2) putting alignment;

3) stance;

4) swing path;

5) weight balance;

6) weight shifting; and 7) ball positioning.

Additionally, the apparatus of the present invention is of a compact construction which can be disassembled for use. When not in use, the present invention can be assembled into a long tubelike form which can be easily stored or carried in a golf bag. In this assembled state, the present invention can also be used as a stretching device. The golfer can place the invention on his shoulders while grasping each end of the apparatus with each hand respectively. In this position, the golfer can simulate a golf swing which acts to stretch the muscles of the golfer before he starts play.

Additionally, the present invention contains a golf retrieving means which can be used to retrieve stray golf balls. The present invention is also preferably comprised of adjustable locking clips which allow the golfer to adjust the length of the apparatus as needed.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which.

DETAILED DESCRIPTION OF THE PREFERRED EMBODIMENTS

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
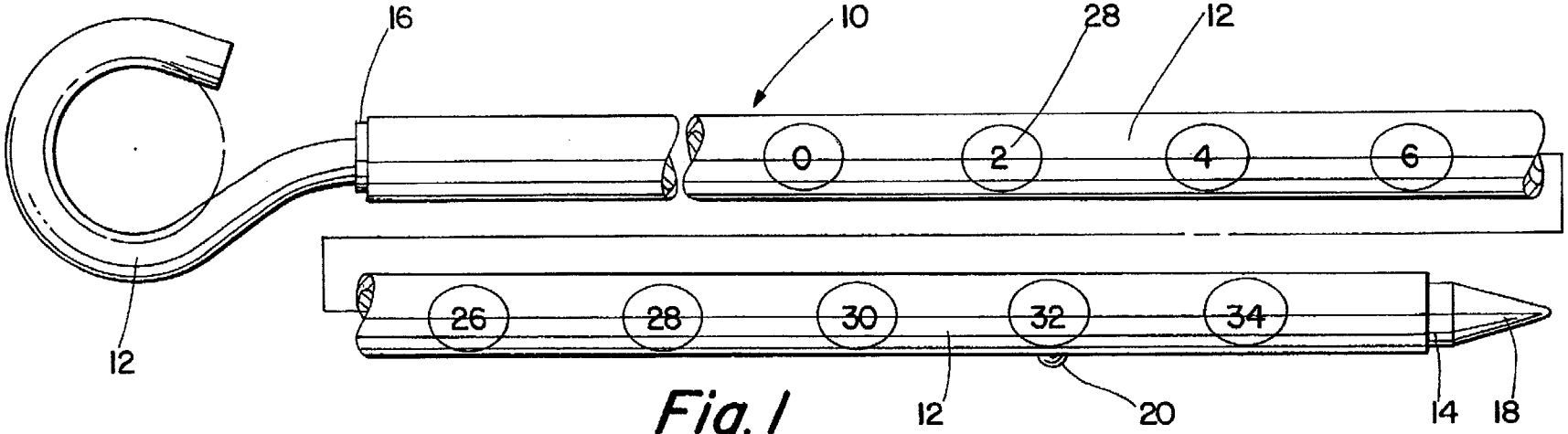
FIG. 1 is a plan view of the present invention in its assembled state.

Referring in more detail to the drawings and particularly FIG. 1, the golf training apparatus 10 of the present invention is comprised mainly of: a center tube, hereinafter referred to as the elongated tube 12; a first end tube, hereinafter referred to as lower leg lateral restraint 14; and a second end tube, hereinafter referred to as the lateral foot restraint 16.

The elongated tube 12 is preferably from 36 inches to 48 inches long. The lower lower leg lateral restraint 14 is preferably 24 inches to 36 inches long. As illustrated in FIG. 1, one end of the lower leg lateral restraint 14 is, preferably, has a sharp point 18 for facilitating the insertion of the lower leg lateral restraint 14 into the ground.

The lateral foot restraint 16 is preferably from 6 to 18 inches long. The lateral foot restraint 16 also has sharp point for facilitating the insertion of the lateral foot restraint 16 into the ground.

The tubes 12, 14, 16 are preferably rigid or semi-rigid and are made of plastic, rubber, or metal; preferably aluminum. In the preferred embodiment, the diameter of the tubes range from ¼ inch to 1 inch and the thickness of the tubes range from 1/32 inch to 1/16 inch. As illustrated in FIG. 1, the lower leg lateral restraint 14 and the lateral foot restraint 16 fit into the first and second ends, respectively, of the elongated tube 12. Any appropriate means can be used to provide a connection between the tubes 12, 14, 16. In the preferred embodiment, locking clips 20 are used to lock the tubes 12, 14, 16 in place.

Figure 3:
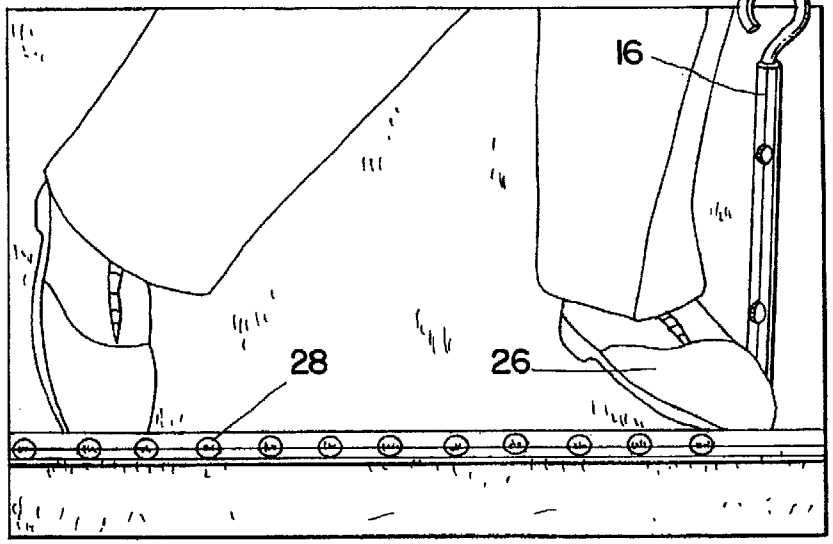
FIG. 3 illustrates the present invention in its unassembled state being used to prevent spin out.
Figure 2:
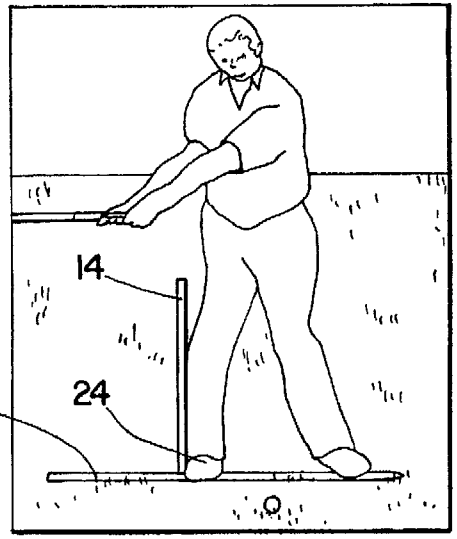
FIG. 2 illustrates the present invention in its unassembled state being used to establish correct weight shifting and swaying.
Figure 4:
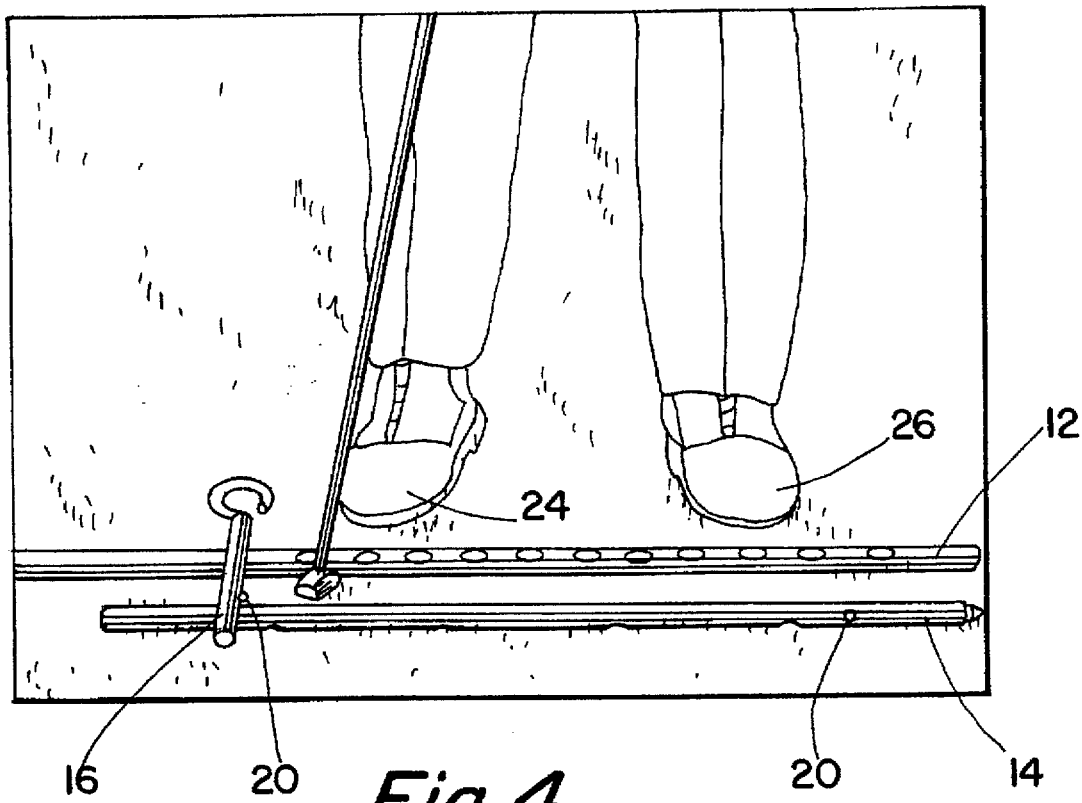
FIG. 4 illustrates the present invention in its unassembled state being used as a putting practice aid.
Figure 5:
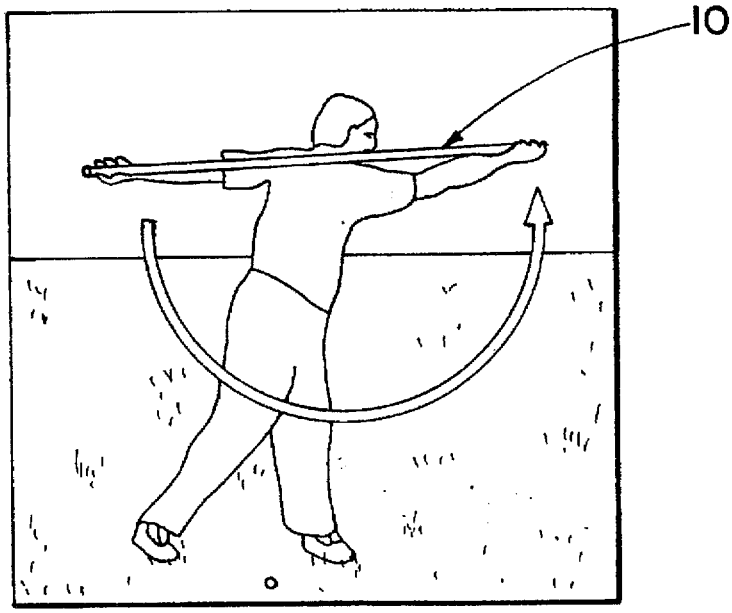
FIG. 5 illustrates the present invention in its assembled and extended state being used for stretching.

The present invention can be unassembled from its assembled state, as shown in FIG. 1. In the preferred embodiment, the means for connecting the tubes 12, 14, 16 is an adjustable locking clip 20. One locking clip 20 may be placed on the lower leg lateral restraint 14 and the lateral foot restraint 16. The locking clips 20 are adjustable, meaning that the tubes 12, 14, 16 can be locked together in positions of varying length. It is also preferred that the locking clip 20 be formed of plastic. Plastic locking clips 20 are economical, fit inside the tubes 12, 14, 16, and do not interfere with the use of the apparatus 10. Upon unlocking the clips 20, the lower leg lateral restraint 14 and the lateral foot restraint 16 can be unassembled into separate components, as illustrated by FIGS. 2, 3 and 4.

In one embodiment, the lower leg lateral restraint 14 has from three to seven slots or grooves, and the lateral foot restraint 16 has from two to five slots or grooves, such that the elongated robe 12 will fit inside the slots of the lower leg lateral restraint 14 and the lateral foot restraint 16.

It is preferred that the lateral foot restraint 16 contain a ball retrieving means 22 which the golfer can use to retrieve stray golf balls.

It is also preferred that the elongated tube 12 contain numerical markings 28 on the exterior surface which represents distances on the elongated tube 12 which a golfer can use in various training activities. For example, referring to FIG. 2, the golfer desiring to prevent swaying could insert the lower leg lateral support 14 into the turf adjacent his lower leg (the back leg). The lower leg lateral support 14 braces the golfer's back foot 24 so that the golfer's weight does not roll to the outside. Practicing this increases power as the lower leg lateral restraint 14 prevents the golfer's weight from rolling to his back foot. The golfer can then correct his or her swing based on the contact of his or her body with the lower leg lateral restraint 14 and the lateral foot restraint 16 resulting from the practice swing.

The apparatus 10 of the present invention also prevents spin out. For example, referring to FIG. 3, the golfer desiring to prevent spin out, which causes the ball to slice, could insert the lateral foot support 16 into the ground adjacent to the golfer's front foot 26. The lateral foot support 16 braces the golfer's front foot 26, thus improving balance.

The apparatus 10 can also be used to correct alignment of one's shot. The elongated tube 12 can be placed on the turf parallel to the lateral axis 28 of the body of the golfer. The lateral foot support 16 can then be laid on, and perpendicular to, the elongated tube 12. The lower leg lateral restraint is then placed parallel to the elongated tube 12, and in the direction of the target location. The golf ball is then placed between the lower leg lateral restraint 14 and the elongated tube 12. This positioning allows the golfer to practice correct alignment of his or her golf shots. In this same set up, the golfer can also improve his swing path. A swing path that goes straight back, or from the inside out, will promote a right to left shot, which generally goes further than other types of shots. Practicing with this set up will help the golfer visualize the proper swing path needed for a straight shot.

The apparatus 10 of the present invention can also be used as a practice putting aide. FIG. 4 illustrates how the elongated tube 12, lower leg lateral restraint 14, and the lateral foot restraint 16 are positioned to improve a putting stroke.

The numerical markings 28, indicating distances, can be used to correct the width of a golfer's stance, the lateral distance of the golf ball from the golfer's front foot 26, and the golfer's distance from the ball.

After practicing with the apparatus 10, the golfer can reassemble the invention to its assembled form as illustrated in FIG. 1. In otherwords, the golfer assembles the apparatus 10 by:

removing the lower leg lateral restraint 14 from the turf;

inserting the lower leg lateral restraint 14 into one end of the elongated tube 12;

removing the lateral foot restraint 16 from the turf;

inserting the lateral foot restraint 16 into the other end of the elongated tube 12;

connecting the lower leg lateral restraint 14 with the elongated tube 12 by an adjustable locking clip 20; and connecting the lateral foot restraint 16 with the elongated tube 12 by an adjustable locking clip 20.

Upon assembly, the golfer can easily insert the assembled apparatus 10 into a golf club bag for storage.

What is claimed is:

1. A golf training apparatus, comprising:

an elongated tube having a first and second end, and a length sufficient to regulate a golfer's stance;

a lower leg lateral restraint having a first and second end, said lower leg lateral restraint movably positioned within said first end of said elongated tube, said first end of said lower leg lateral restraint having a sharp point for facilitating the insertion of said lower leg lateral restraint into the ground;

a lateral foot restraint having a first and second end, said lateral foot restraint movably positioned within said second end of said elongated tube, said first end of said lateral foot restraint having a sharp point for facilitating the insertion of said lateral foot restraint into the ground;

a locking mechanism for locking said elongated tube, said lower leg lateral restraint, and said lateral foot restraint together; and wherein said elongated tube, said lower leg lateral restraint, and said lateral foot restraint can be disassembled into separate components for use as a golf training apparatus.

2. A golf training apparatus as recited in claim 1, wherein said second end of said lateral foot restraint contains a ball retrieving means.

3. A golf training apparatus as recited in claim 1, wherein said locking mechanism for locking said elongated tube, said lower leg lateral restraint, and said lateral foot restraint together is an adjustable locking clip means.

4. A golf training apparatus as recited in claim 1, wherein said elongated tube contains numerical markings on the exterior surface which represents distances on said elongated tube which a golfer can use in various training activities.

5. A golf training apparatus as recited in claim 1, wherein said lower leg lateral support is any length between 24 inches to 36 inches long.

6. A golf training apparatus as recited in claim 1, wherein said elongated tube is any length between 36 to 48 inches long.

7. A golf training apparatus as recited in claim 1, wherein said elongated tube, said lower leg lateral restraint, and said lateral foot restraint are rigidly formed from plastic, rubber, or metal.

8. A golf training apparatus as recited in claim 1, wherein said elongated tube, said lower leg lateral restraint, and said lateral foot restraint have diameters from ¼ inch to 1 inch, and wherein the thickness of said elongated tube, said lower leg lateral restraint, and said lateral foot restraint are from 1/32 inch to 1/16 inch.

* * * * *